US009905955B2

(12) United States Patent
Endo et al.

(10) Patent No.: US 9,905,955 B2
(45) Date of Patent: Feb. 27, 2018

(54) TERMINAL AND CONNECTOR

(71) Applicant: Dai-ichi Seiko Co., Ltd., Kyoto-shi, Kyoto (JP)

(72) Inventors: Takayoshi Endo, Shizuoka (JP); Sakai Yagi, Shizuoka (JP); Hiroyuki Kurita, Shizuoka (JP); Shuji Touno, Shizuoka (JP)

(73) Assignee: DAI-ICHI SEIKO CO., LTD., Kyoto-Shi, Kyoto (JP)

( * ) Notice: Subject to any disclaimer, the term of this patent is extended or adjusted under 35 U.S.C. 154(b) by 0 days.

(21) Appl. No.: 15/489,365

(22) Filed: Apr. 17, 2017

(65) Prior Publication Data

US 2017/0317441 A1 Nov. 2, 2017

(30) Foreign Application Priority Data

Apr. 27, 2016 (JP) ..... 2016-089095

(51) Int. Cl.

| | |
|---|---|
| ***H01R 11/22*** | (2006.01) |
| ***H01R 13/432*** | (2006.01) |
| ***H01R 13/11*** | (2006.01) |
| ***H01R 4/18*** | (2006.01) |
| ***H01R 13/424*** | (2006.01) |

(52) U.S. Cl.

CPC ..... *H01R 13/432* (2013.01); *H01R 4/185* (2013.01); *H01R 13/113* (2013.01); *H01R 13/424* (2013.01)

(58) Field of Classification Search

CPC .. H01R 13/426; H01R 13/187; H01R 13/115; H01R 13/111; H01R 13/113

USPC ..... 439/744, 843, 845, 849, 850, 851, 852

See application file for complete search history.

(56) References Cited

U.S. PATENT DOCUMENTS

| | | | | |
|---|---|---|---|---|
| 3,058,091 A | | 10/1962 | Henschen | |
| 4,209,220 A | * | 6/1980 | Szablowski | H01R 12/57 439/77 |
| 4,781,628 A | | 11/1988 | Detter et al. | |

(Continued)

FOREIGN PATENT DOCUMENTS

| | | |
|---|---|---|
| EP | 2797173 A1 | 10/2014 |
| JP | 06-310218 A | 11/1994 |

(Continued)

OTHER PUBLICATIONS

Extended European Search Report (App. No. 17167901.2-1801); dated Jun. 20, 2017; 12 pages.

(Continued)

*Primary Examiner* — Thanh Tam Le

(74) *Attorney, Agent, or Firm* — Howard & Howard Attorneys PLLC

(57) ABSTRACT

The terminal comprises a conductive contact plate, a conductive body, an extended part, and a lance. The conductive contact plate is elastic and makes contact with a counterpart terminal. The conductive body supports the conductive contact plate and comprises a side plate. The extended part comprises a folded part extending from the +Z-side end of the side plate and folded outward from the conductive body and an overlapped part extending from the leading end of the folded part and overlapping with the side plate. The lance is a member protruding from the overlapped part and having the shape of a cantilever beam.

10 Claims, 11 Drawing Sheets

(56) References Cited

U.S. PATENT DOCUMENTS

| | | | | |
|---|---|---|---|---|
| 5,389,013 | A * | 2/1995 | Kourimsky | H01R 13/432 439/744 |
| 6,019,646 | A * | 2/2000 | Okamura | H01R 13/113 439/748 |
| 6,106,339 | A * | 8/2000 | Nagai | H01R 13/432 439/744 |
| 6,520,811 | B2 * | 2/2003 | Mitani | H01R 13/113 439/843 |
| 6,905,376 | B2 * | 6/2005 | Chen | H01R 13/4223 439/595 |
| 7,048,582 | B2 * | 5/2006 | Tabata | H01R 13/113 439/595 |
| 7,371,133 | B1 * | 5/2008 | Morello | H01R 13/187 439/852 |
| 7,537,497 | B2 * | 5/2009 | Tyler | H01R 13/187 439/843 |
| 7,976,351 | B2 * | 7/2011 | Boemmel | H01R 13/432 439/748 |
| 8,267,729 | B2 * | 9/2012 | Yamashita | H01R 13/111 439/751 |
| 9,011,186 | B2 * | 4/2015 | Wirth | H01R 13/112 439/843 |
| 9,153,879 | B2 * | 10/2015 | Frimmersdorf | H01R 4/28 |
| 2005/0287878 | A1 | 12/2005 | Urbaniak et al. | |

FOREIGN PATENT DOCUMENTS

| | | | |
|---|---|---|---|
| JP | 10-247543 | A | 9/1998 |
| JP | 2002-124335 | A | 4/2002 |
| JP | 2004-039534 | A | 2/2004 |
| JP | 3745634 | B2 | 2/2006 |
| JP | 2015-519709 | A | 7/2015 |
| WO | 2014/045957 | A1 | 3/2014 |

OTHER PUBLICATIONS

Notice of Reasons for Refusal (JP Patent Application No. 2016-089095); dated Nov. 7, 2017; 8 pages.

* cited by examiner

TERMINAL AND CONNECTOR

CROSS-REFERENCE TO RELATED APPLICATION

This application claims the benefit of Japanese Patent Application No. 2016-089095, filed on Apr. 27, 2016, the entire disclosure of which is incorporated by reference herein.

TECHNICAL FIELD

This application relates generally to a terminal and a connector.

BACKGROUND ART

For example, as seen with reference to Patent Literature 1 (Unexamined Japanese Patent Application Kokai Publication No. H10-247543), a terminal inserted in the housing of a connector has a lance formed to be locked in a lance locking part formed within the housing. As the lance is locked in the lance locking part, the terminal is retained in the housing in an unremovable state.

The terminal described in the Patent Literature 1 has a lance formed by being cut out and raised from a sidewall of a terminal body made of a metal plate. Therefore, the rigidity of the sidewall easily lowers and consequently the strength of terminal may lower. Particularly, when the terminal is made small in height, the strength of the terminal easily significantly lowers and it is difficult to respond to the request for making a terminal small in height using the prior art structure.

The present disclosure is made with the view of the above situation and an objective of the disclosure is to realize a terminal small in height while maintaining the strength of the terminal.

SUMMARY OF THE INVENTION

The terminal according to a first exemplary aspect of the present disclosure comprises:

a conductive contact plate elastic and making contact with a counterpart terminal;

a tube-like conducive body supporting the conductive contact plate and comprising a first wall;

a first extended part comprising a first folded part extending from an end of the first wall and folded outward from the conductive body and a first overlapped part extending from a leading end of the first folded part and overlapping with the first wall; and a first lance in the shape of a cantilever beam protruding from the first overlapped part.

The following may be possible:

the conductive body comprises a second wall facing the first wall, and the conductive contact plate is disposed between the first wall and the second wall.

It may be possible to comprise:

a second extended part comprising a second folded part extending from an end of the second wall and folded outward from the conductive body and a second overlapped part extending from a leading end of the second folded part and overlapping with the second wall; and a second lance in the shape of a cantilever beam protruding from the second overlapped part.

A protrusion protruding from an outer wall surface of the first wall and abutting on the first overlapped part may be formed on the conductive body.

The first folded part may be folded at an axial line parallel to an axial direction of the conductive body.

The first folded part may be folded at an axial line parallel to a direction perpendicular to the axial direction of the conductive body.

The following may be possible:

the first wall faces the conductive contact plate, and the first folded part is folded at an axial line parallel to a direction perpendicular to the axial direction of the conductive body.

The first lance may comprise a fold line part in the shape of a fold line formed in parallel to a protruding direction.

The following may be possible:

the first extended part is formed at one end of the conductive body, an other-end extended part formed at the other end of the conductive body with the first lance in-between is provided, and the other-end extended part comprises an other-end folded part extending from an end of the first wall and folded outward from the conductive body and an other-end overlapped part extending from a leading end of the other-end folded part and overlapping with the first wall.

The connector according to a second exemplary aspect of the present disclosure comprises:

the terminal according to the first exemplary aspect of the present disclosure; and a housing in which an engaging part engaging with the first lance is formed.

According to the present disclosure, the first lance protrudes from the first overlapped part overlapping with the first wall. Therefore, reduction in the rigidity of the wall due to formation of the lance is suppressed. Consequently, it is possible to realize a terminal small in height while maintaining the strength of the terminal.

BRIEF DESCRIPTION OF THE DRAWINGS

A more complete understanding of this application can be obtained when the following detailed description is considered in conjunction with the following drawings, in which.

DETAILED DESCRIPTION OF THE EMBODIMENT

Embodiment 1

The terminal and connector according to Embodiment 1 of the present disclosure will be described below with reference to FIGS. 1 to 8. Here, for easier understanding, XYZ coordinates are set up and referred to as necessary. Moreover, the axial direction of the conductive body of the terminal is parallel to the Y-axis direction.

Figure 1:
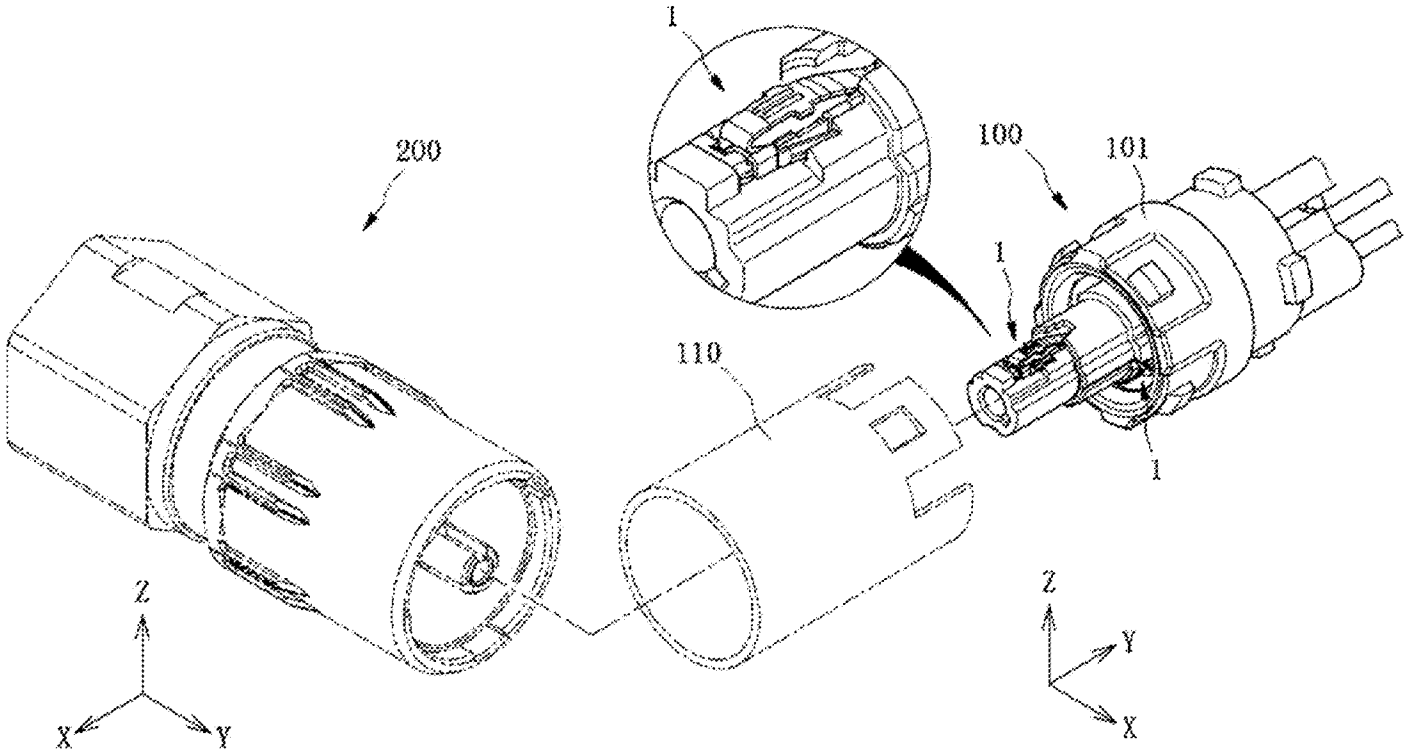
FIG. 1 is a perspective view of the connector according to Embodiment 1 of the present disclosure.

A connector 100 according to Embodiment 1 of the present disclosure is, for example, a non-directional connector used in electronic circuit parts mounted on vehicles. The connector 100 is connected to a counterpart connector 200 comprising a male terminal as shown in FIG. 1. The connector 100 comprises a terminal 1, a housing 101, and a cover 110. The cover 110 is attached to the housing 101 and covers the housing 101 in part.

Figure 2A:
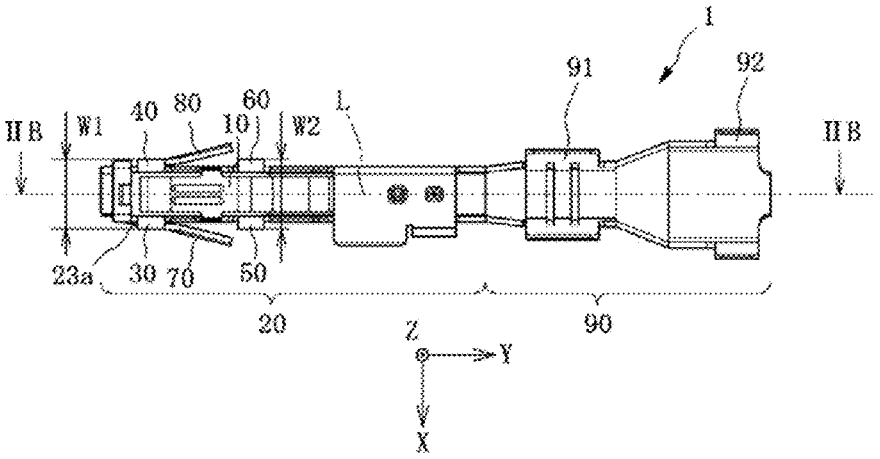
FIG. 2A is a plane view of the terminal according to Embodiment 1.
Figure 2B:
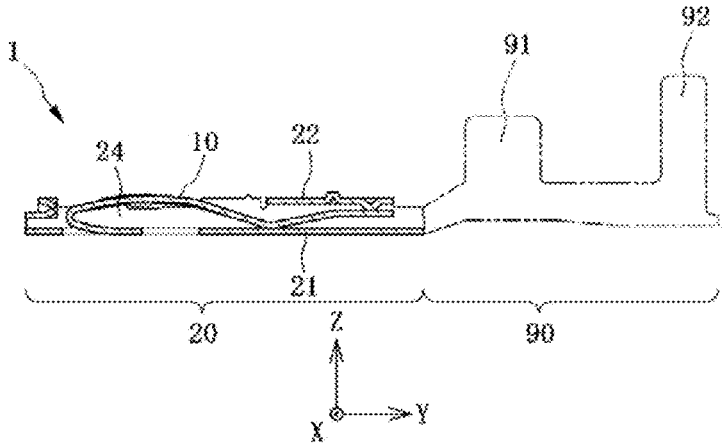
FIG. 2B is a cross-sectional view at the line IIB-IIB in FIG. 2A.

The terminal 1 comprises a female terminal in a shape extending in the Y-axis direction as shown in FIGS. 2A and 2B. In this embodiment, the terminal 1 is formed from a sheet of metal plate. However, this is not restrictive and the terminal 1 may be a multiple-piece type terminal formed from two or more metal plates. The terminal 1 comprises a conductive contact plate 10, a conductive body 20, extended parts 30, 40, 50, and 60, lances 70 and 80, and a caulking part 90.

The conductive contact plate 10 is a leaf spring member formed from an elastic and conductive plate material consisting of copper, copper alloy or the like. The conductive contact plate 10 has an arched part formed into the shape of an arch protruding to the +Z side. The conductive contact plate 10 is covered by the conductive body 20 and the arched part of the conductive contact plate 10 is exposed from the conductive body 20. The +Z-side surface of the arched part of the conductive contact plate 10 makes contact with a male terminal that is the counterpart terminal.

Figure 3:
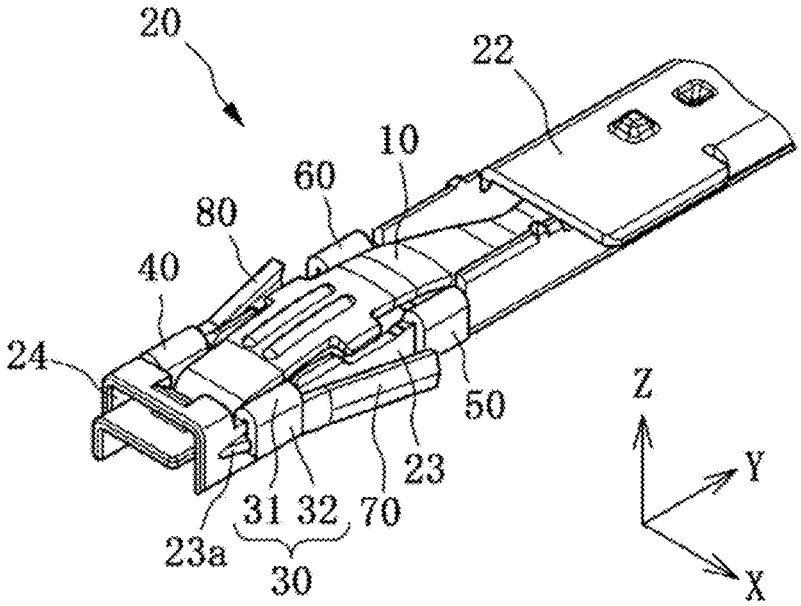
FIG. 3 is a perspective view (No. 1) of the conductive body according to Embodiment 1.

The conductive body 20 is a member supporting the conductive contact plate 10. The conductive body 20 is formed, as shown in FIGS. 2B and 3, into the shape of a square tube comprising a bottom plate 21, a top plate 22, a side plate 23 (the first wall) that is the side wall on the +X side, and a side plate 24 (the second wall) that is the sidewall on the −X side. The bottom plate 21 faces the top plate 22 and the side plate 23 faces the side plate 24. The conductive contact plate 10 is disposed between the side plate 23 and the side plate 24 of the conductive body 20. The conductive body 20 is made of a conductive material such as copper, copper alloy, and the like.

A protrusion 23*a* protruding from the outer wall surface of the side plate 23 is formed on the conductive body 20. The protrusion 23*a* is provided at a position adjoining the −Y-side end of the extended part 30. In this Embodiment 1, the protrusion 23*a* is formed on the side plate 23 but is not formed on the side plate 24.

Figure 4A:
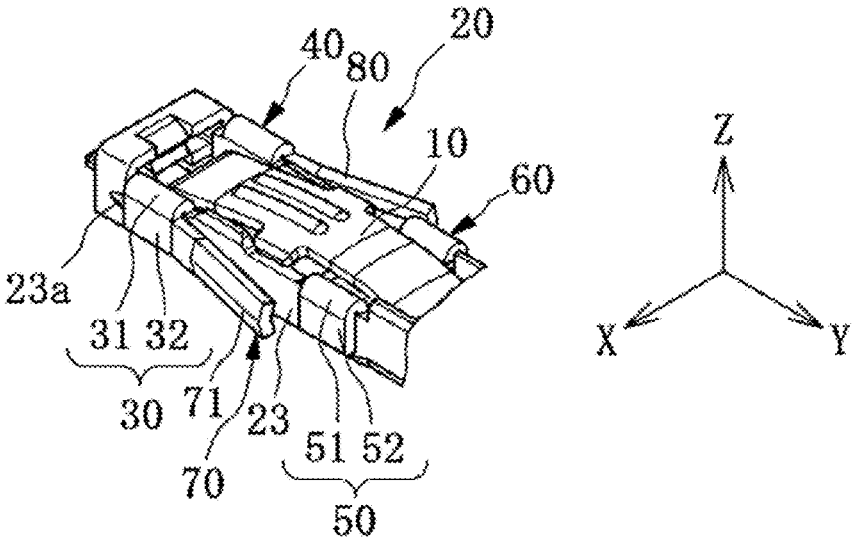
FIG. 4A is a perspective view (No. 2) of the conductive body according to Embodiment 1.

The extended part 30 (the first extended part) is formed at the end on the +X side and on the −Y side (one end) of the conductive body 20 as shown in FIG. 4A. The extended part 30 has a folded part 31 and an overlapped part 32.

Figure 4B:
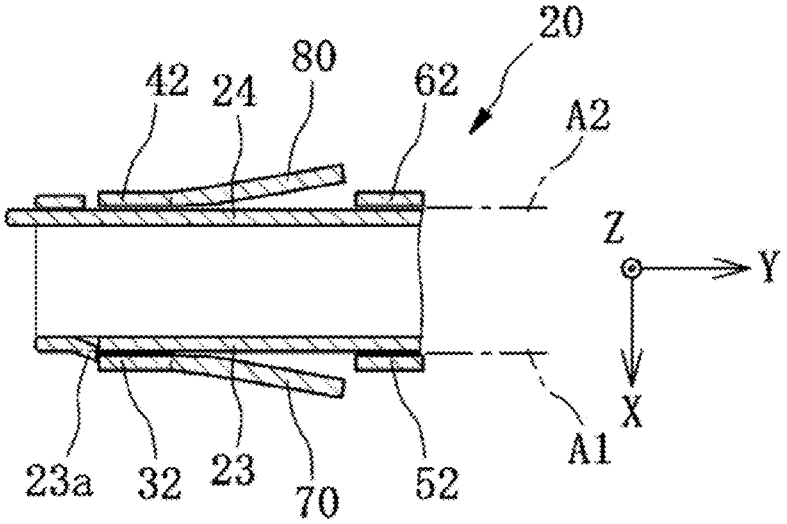
FIG. 4B is an XY cross-sectional view of the conductive body according to Embodiment 1.

The folded part 31 extends from the upper end (the +Z-side end) of the side plate 23 and is folded outward from the conductive body 20. In detail, as shown in FIGS. 4A and 4B, the folded part 31 is folded at an axial line A1 parallel to the Y-axis direction.

The overlapped part 32 extends from the leading end of the folded part 31 and overlaps with the side plate 23. This overlapped part abuts on the protrusion 23*a* formed on the side plate 23.

Figure 5A:
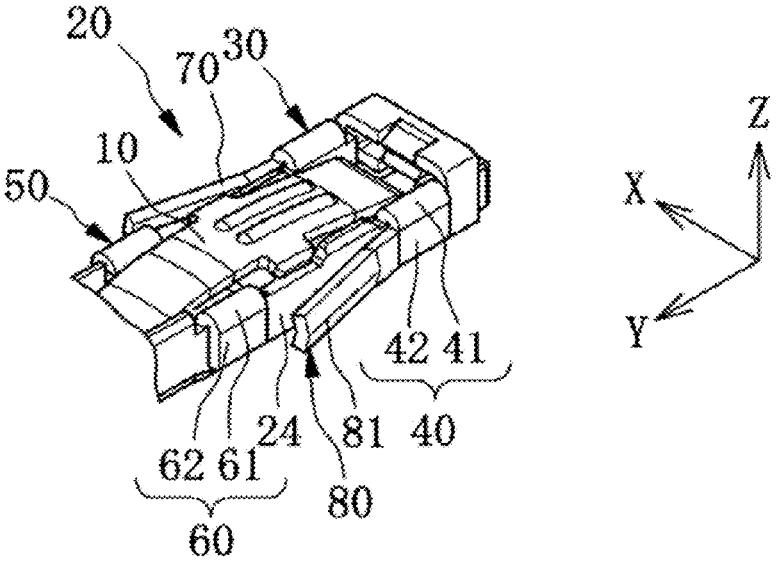
FIG. 5A is a perspective view (No. 3) of the conductive body according to Embodiment 1.

The extended part 40 (the second extended part) is formed at the end on the −X side and on the −Y side of the conductive body 20 as shown in FIG. 5A. The extended part 40 has a folded part 41 and an overlapped part 42 like the extended part 30.

The folded part 41 extends from the upper end (the +Z-side end) of the side plate 24 and is folded outward from the conductive body 20. In detail, as shown in FIGS. 5A and 4B, the folded part 41 is folded at an axial line A2 parallel to the Y-axis direction.

The overlapped part 42 extends from the leading end of the folded part 41 and overlaps with the side plate 24.

The extended part 40 and the extended part 30 are formed at positions symmetric about an axis L parallel to the axial direction of the conductive body 20 in a plane view shown in FIG. 2A.

The extended part 50 (the other-end extended part) is formed, as shown in FIG. 4A, on the opposite side to the position where the extended part 30 is formed in the Y-axis direction with the lance 70 in-between. The extended part 50 has a folded part 51 and an overlapped part 52.

The folded part 51 extends from the upper end (the +Z-side end) of the side plate 23 and is folded outward from the conductive body 20. In detail, as shown in FIGS. 4A and 4B, the folded part 51 is folded at the axial line A1 parallel to the Y-axis direction.

The overlapped part 52 extends from the leading end of the folded part 51 and overlaps with the side plate 23.

The extended part 60 is formed, as shown in FIG. 5A, on the opposite side to the position where the extended part 40 is formed in the Y-axis direction with the lance 80 in-between. The extended part 60 has a folded part 61 and an overlapped part 62 like the extended part 50.

The folded part 61 extends from the upper end (the +Z-side end) of the side plate 24 and is folded outward from the conductive body 20. In detail, as shown in FIGS. 5A and 4B, the folded part 61 is folded at the axial line A2 parallel to the Y-axis direction.

The overlapped part 62 extends from the leading end of the folded part 61 and overlaps with the side plate 24.

The extended part 60 and the extended part 50 are formed at positions symmetric about the axis L parallel to the axial direction of the conductive body 20 in a plane view shown in FIG. 2A.

Figure 5B:
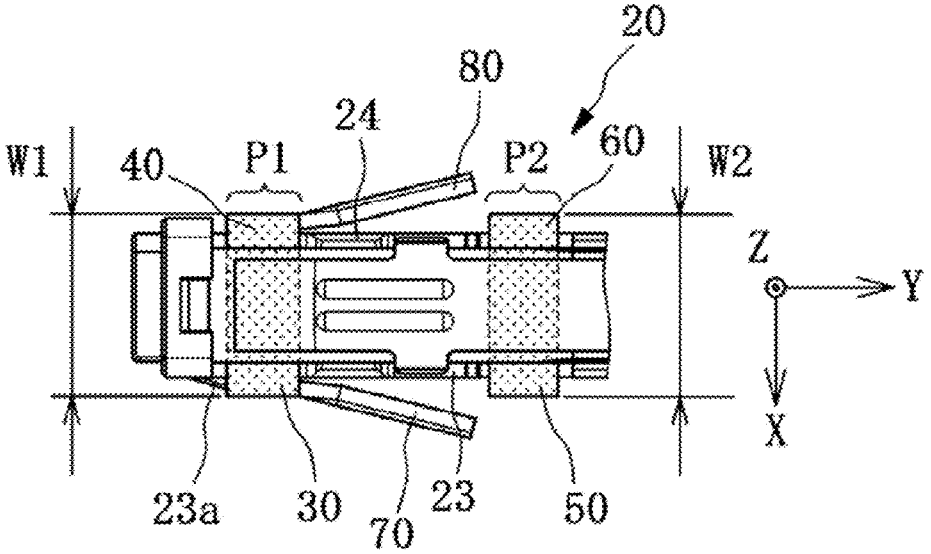
FIG. 5B is a plane view of the conductive body according to Embodiment 1.

Moreover, the conductive body 20 has, as shown in FIG. 5B, a one-end extended part formation part P1 constructed to include the extended parts 30 and 40 and an other-end extended part formation part P2 constructed to include the extended parts 50 and 60. Here, in FIG. 5B, the one-end extended part formation part P1 and the other-end extended part formation part P2 are dotted for easier understanding. The width W1 of the one-end extended part formation part P1 (the width W1 between the outer surface of the extended part 30 and the outer surface of the extended part 40) and the width W2 of the other-end extended part formation part P2 (the width W2 between the outer surface of the extended part 50 and the outer surface of the extended part 60) are equal. However, this is not restrictive. The width W2 may be slightly smaller than the width W1 or slightly larger than the width W1.

The lance 70 (the first lance) is formed to be locked in a lance locking part of the housing so as to retain the terminal 1 in the housing in an unremovable state. The lance 70 is formed to protrude from the overlapped part 32 of the extended part 30 as shown in FIG. 4A. As a result, the lance 70 is formed into the shape of a cantilever beam having the end closer to the overlapped part 32 as a fixed end and the opposite end as a free end. Moreover, the lance 70 has a fold line part 71 in the shape of a fold line formed in parallel to the protruding direction. The lance 70 is bent along the fold line part 71.

The lance 80 (the second lance) is formed to be locked in a lance locking part of the housing so as to retain the terminal 1 in the housing in an unremovable state. The lance 80 is formed to protrude from the overlapped part 42 of the extended part 40 as shown in FIG. 5A. As a result, the lance 80 is formed into the shape of a cantilever beam having the end closer to the overlapped part 42 as a fixed end and the opposite end as a free end. Moreover, the lance 80 has a fold line part 81 in the shape of a fold line formed in parallel to the protruding direction. The lance 80 is bent along the fold line part 81. The lance 80 and the lance 70 are formed symmetrically about the axis L in a plane view shown in FIG. 2A.

The caulking part 90 comprises a conductor caulking part 91 and a cladding fixing part 92 as shown in FIGS. 2A and 2B. Pressed against the leading end of the core line of an insulating-clad line by caulking, the conductor caulking part 91 is electrically connected. Pressing the end of the insulating-clad line by caulking, the cladding fixing part 92 protects the connection between the conductor caulking part 91 and the core line from a drawing force. Since the caulking part 90 and conductive body 20 are formed in one piece, the core line against which the conductor caulking part 91 is pressed and the male terminal connected to the conductive body 20 are electrically connected.

Figure 6A:
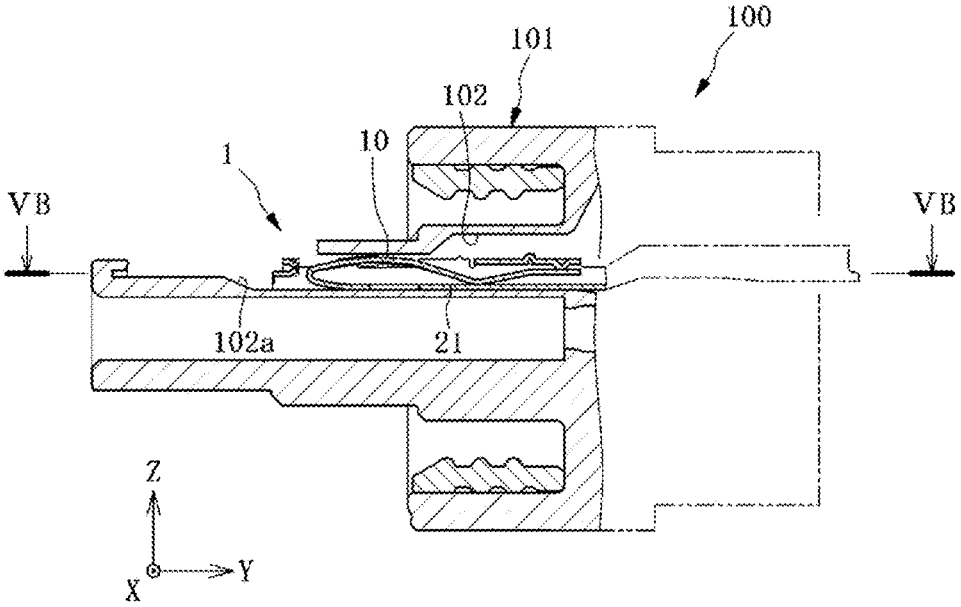
FIG. 6A is a YZ cross-sectional view (No. 1) showing the process of mounting the terminal according to Embodiment 1 in a housing.
Figure 6B:
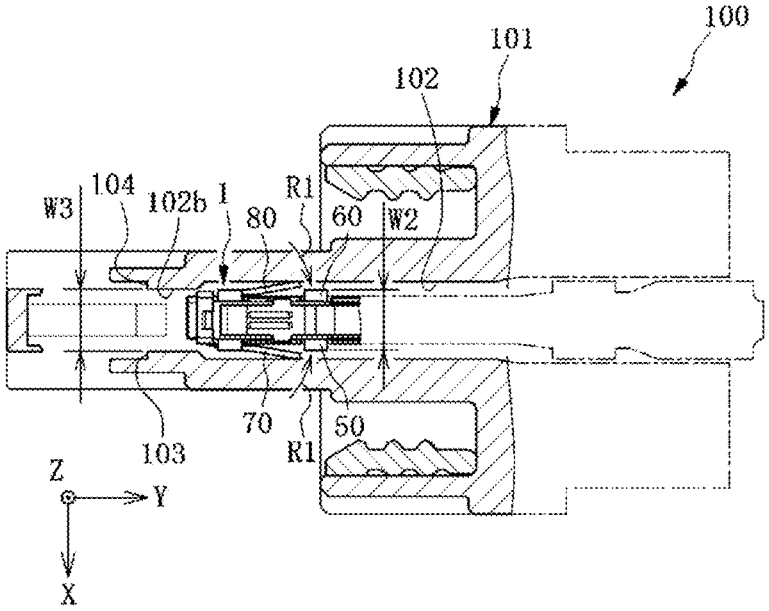
FIG. 6B is an XY cross-sectional view (No. 1) showing the process of mounting the terminal according to Embodiment 1 in a housing.

The terminal 1 having the above structure is mounted in the housing 101 formed into a nearly cylindrical shape as shown in FIGS. 6A and 6B.

The housing 101 is made of an insulating material. A terminal housing space 102 housing the terminal 1 and lance locking parts 103 and 104 are formed in the housing 101.

As shown in FIG. 6A, a tilted surface 102*a* tilted with respect to the Y-axis direction is formed on the bottom surface of the terminal housing space 102 (the surface facing the bottom plate 21 of the conductive body 20). Moreover, a fit-in space 102*b* is formed in the terminal housing space 102 as shown in FIG. 6B, which has the smallest width in the terminal housing space 102. The fit-in space 102*b* has a width W3 (the length in the X-axis direction) equal to the width W2 of the other-end extended part formation part P2 of the conductive body 20.

With the lances 70 and 80 of the terminal 1 being locked in, the lance locking parts 103 and 104 retain the terminal 1 in the housing 101 in an unremovable state.

Operation of the members when the terminal 1 is mounted in the housing 101 will be described next with reference to FIGS. 6 to 8.

The user who mounts the terminal 1 into the housing 101 inserts the terminal 1 into the terminal housing space 102 of the housing 101 from the opening on the +Y side as shown in FIG. 6A. Then, the terminal 1 shifts within the terminal housing space 102 in the −Y direction with the arched part of the conductive contact plate 10 being flexed. Moreover, the terminal 1 shifts within the terminal housing space 102 with the lances 70 and 80 being flexed in the directions indicated by the arrows R1 as shown in FIG. 6B.

Figure 7A:
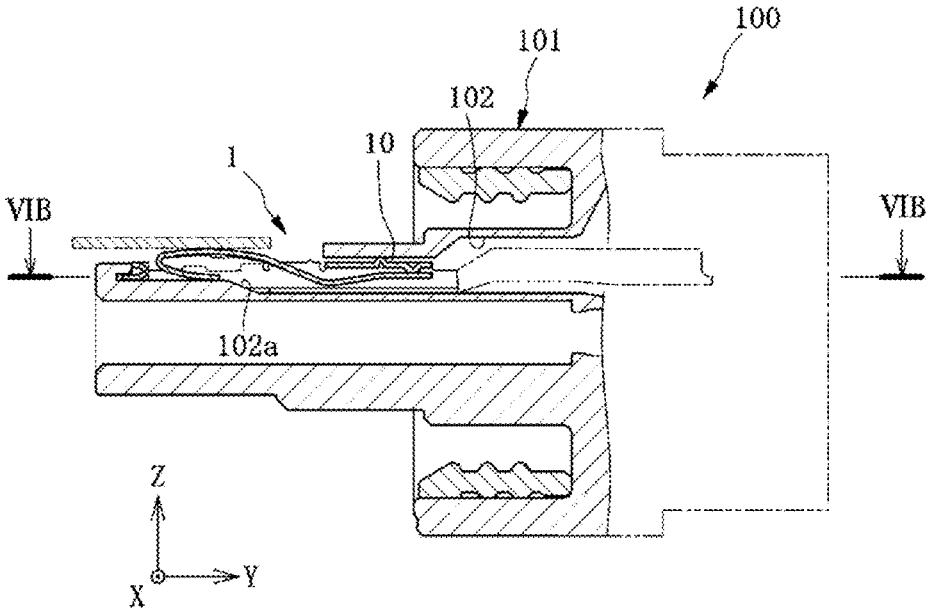
FIG. 7A is a YZ cross-sectional view (No. 2) showing the process of mounting the terminal according to Embodiment 1 in a housing.
Figure 7B:
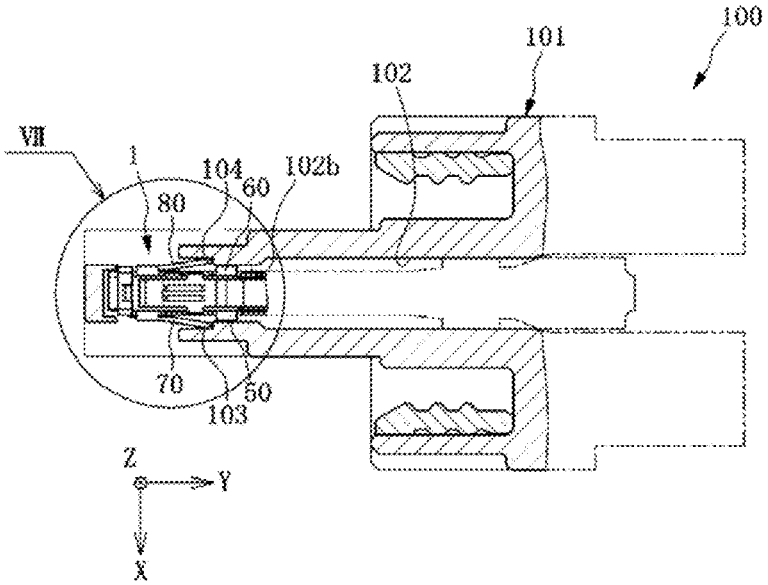
FIG. 7B is an XY cross-sectional view (No. 2) showing the process of mounting the terminal according to Embodiment 1 in a housing.

Next, as the terminal 1 shifts within the terminal housing space 102, the conductive contact plate 10 of the terminal 1 reaches the tilted surface 102*a*. Then, guided by the tilted surface 102*a*, the conductive contact plate 10 is flexed to the +Z side and the arched part of the conductive contact plate 10 protrudes in the +Z direction as shown in FIG. 7A. Moreover, as shown in FIGS. 7B and 8, the terminal 1 has the lances 70 and 80 elastically restored in the directions indicated by the arrows R2 and the lances 70 and 80 are locked in the lance locking parts 103 and 104. As a result, the terminal 1 is retained in the housing 101 in the state of being unremovable from the housing 101 in the +Y direction. Moreover, the other-end extended part formation part P2 of the conductive body 20 is fitted in the fit-in space 102*b*. Here, in FIG. 8, the other-end extended part formation part P2 is dotted for easier understanding.

The method of removing the terminal 1 from the housing 101 will be described next with reference to FIG. 9A.

Figure 9A:
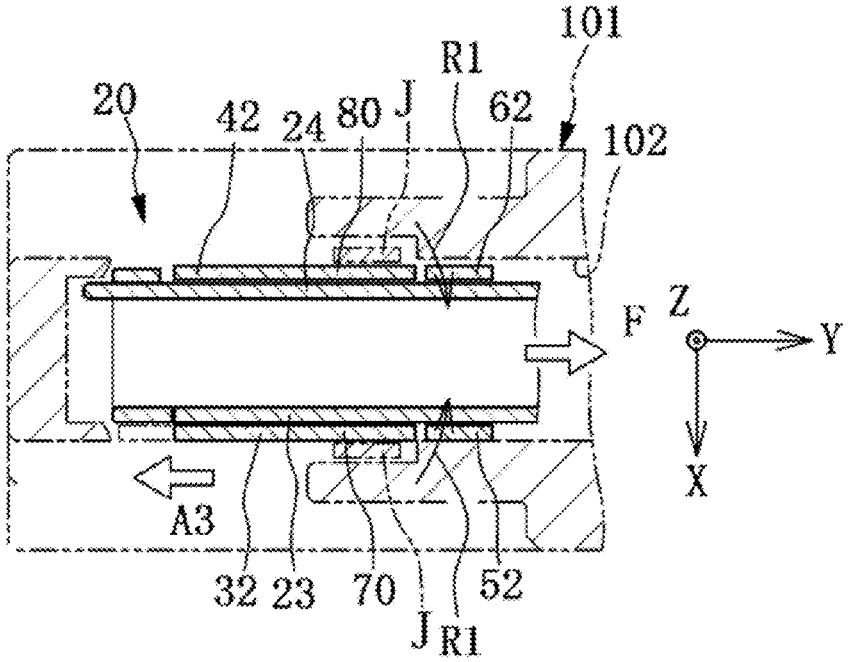
FIG. 9A is an illustration for explaining the method of removing the terminal according to Embodiment 1 from the housing.

For removing the terminal 1 from the housing 101, as seen with reference to FIG. 9A, the user flexes the lances 70 and 80 in the directions indicated by the arrows R1 using a dedicated jig J. As a result, the lances 70 and 80 are unlocked from the lance locking parts 103 and 104. Next, the terminal 1 is pulled in the +Y direction. Then, removal of the terminal 1 from the housing 101 is completed.

As described above, according to the terminal 1 according to this Embodiment 1, as shown in FIGS. 3 and 4A, the lances 70 and 80 protrude from the overlapped parts 32 and 42 overlapping with the side plates 23 and 24. Therefore, reduction in the rigidity of the side plates 23 and 24 due to formation of the lances 70 and 80 is suppressed. As a result, the thickness (the measurement in the Z-axis direction) of the terminal 1 can be reduced. Consequently, it is possible to make the terminal 1 small in height while maintaining the strength of the terminal 1.

Moreover, in this Embodiment 1, the protrusion 23*a* protruding from the outer wall surface of the side plate 23 and abutting on the overlapped part 32 is formed on the conductive body 20. The protrusion 23*a* functions as a stopper regulating deformation of the overlapped part 32 with respect to the side plate 23 when a force in the direction of removing the terminal 1 from the housing 101 is applied.

For example, a case in which the protrusion 23*a* is not formed on the conductive body 20 will be described. When some action different from the normal action of removing the terminal 1 from the housing 101 is taken, an unexpected force F different from the normal removal force may be applied to the conductive body 20 because the lances 70 and 80 are locked in the lance locking parts 103 and 104. In such a case, the overlapped part 32 may be deformed with respect to the side plate 23 in the direction indicated by the arrow A3 in FIG. 9A (in the −Y direction). On the other hand, in this Embodiment 1, as shown in FIGS. 3 and 4A, the protrusion 23*a* functions as a stopper and it is possible to suppress deformation of the overlapped part 32 with respect to the side plate 23 when an unexpected force F is applied to the conductive body 20.

Figure 8:
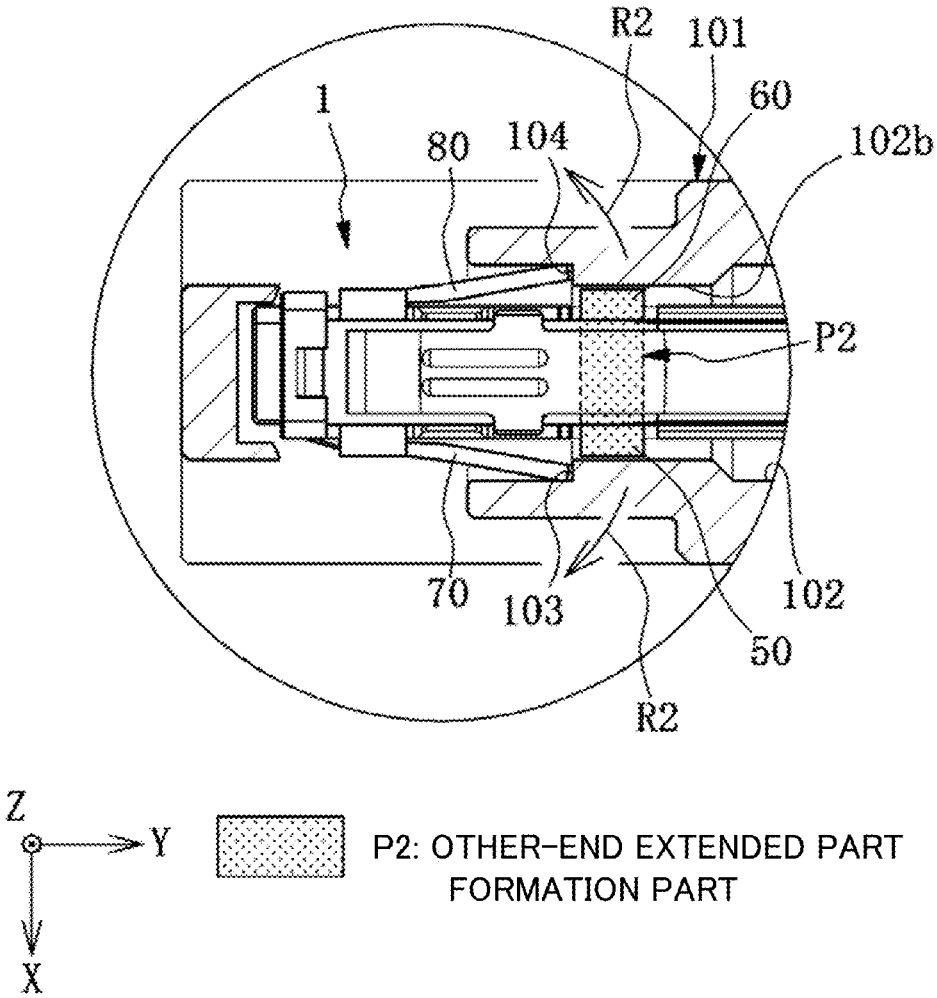
FIG. 8 is an enlarged view of the part indicated by the arrow VII in FIG. 7B.

Moreover, the terminal 1 according to this Embodiment 1 comprises the extended parts 50 and 60 as shown in FIG. 8. The width W2 in the X-axis direction of the other-end extended part formation part P2 constructed to include the extended parts 50 and 60 is equal to the width W3 in the X-axis direction of the fit-in space 102*b* of the terminal housing space 102 of the housing 101 (see FIG. 6B). Therefore, as the terminal 1 is housed in the terminal housing space 102, the other-end extended part formation part P2 is fitted in the fit-in space 102*b*, whereby it is possible to suppress wobbling of the terminal 1 housed in the terminal housing space 102. Moreover, it is possible to suppress unlocking of the lances 70 and 80 from the lance locking parts 103 and 104 as a result of the terminal 1 being biased in the −X direction or in the +X direction within the terminal housing space 102. Here, the same effect can be obtained even if the width W2 is slightly larger or slightly smaller than the width W3.

Figure 9B:
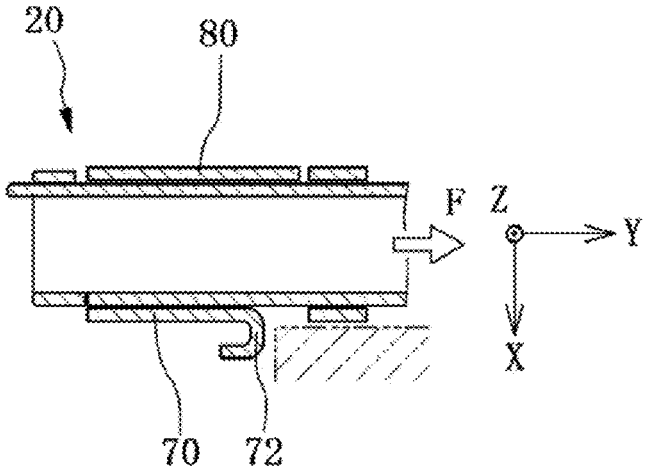
FIG. 9B is an illustration for explaining the action and effect of the lance according to Embodiment 1.

Moreover, in the terminal 1 according to this Embodiment 1, as shown in FIG. 4A, the lances 70 and 80 have the fold line parts 71 and 81 formed in parallel to the protruding direction. The fold line parts 71 and 81 can improve the strength of the lances 70 and 80. Moreover, it is possible to suppress return of the free ends of the lances 70 and 80 when an unexpected force F different from the normal removal force is applied to the conductive body 20. For example, in the case shown in FIG. 9B in which the lances 70 and 80 do not have the fold line parts 71 and 81, there is the risk of the free end of the lance 70 being returned in the −Y direction and a returned part 72 being formed on the lance 70 when an unexpected force F is applied to the conductive body 20. However, in this Embodiment 1, the lances 70 and 80 have the fold line parts 71 and 81, whereby it is possible to suppress return of the free ends of the lances 70 and 80 and consequently improve the retention of the terminal 1 in the housing 101.

Embodiment 2

The terminal according to Embodiment 2 of the present disclosure will be described below with reference to FIGS. 10A and 10B. Mainly the difference from Embodiment 1 will be described. It is assumed that the matters other than the described difference are the same as in Embodiment 1. Here, for easier understanding, XYZ coordinates are set up and referred to as necessary.

Figure 10A:
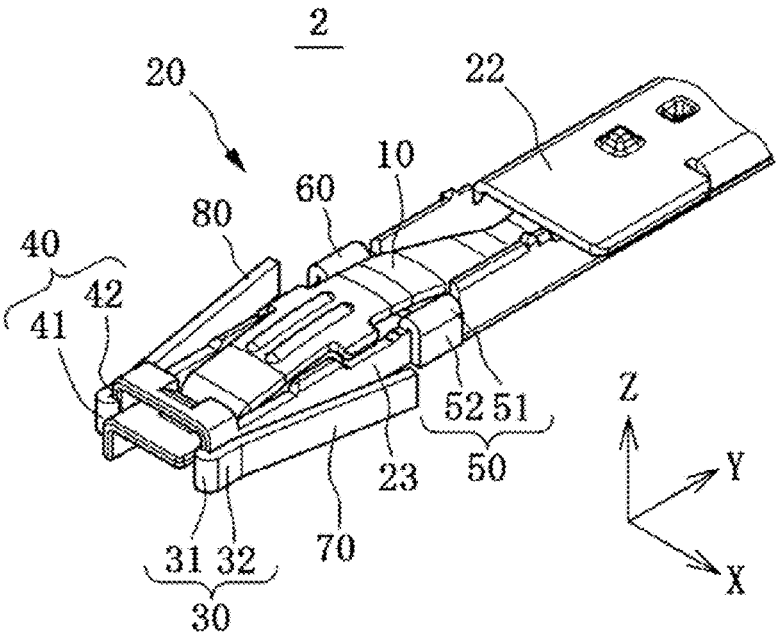
FIG. 10A is a perspective view of the connector according to Embodiment 2 of the present disclosure.
Figure 10B:
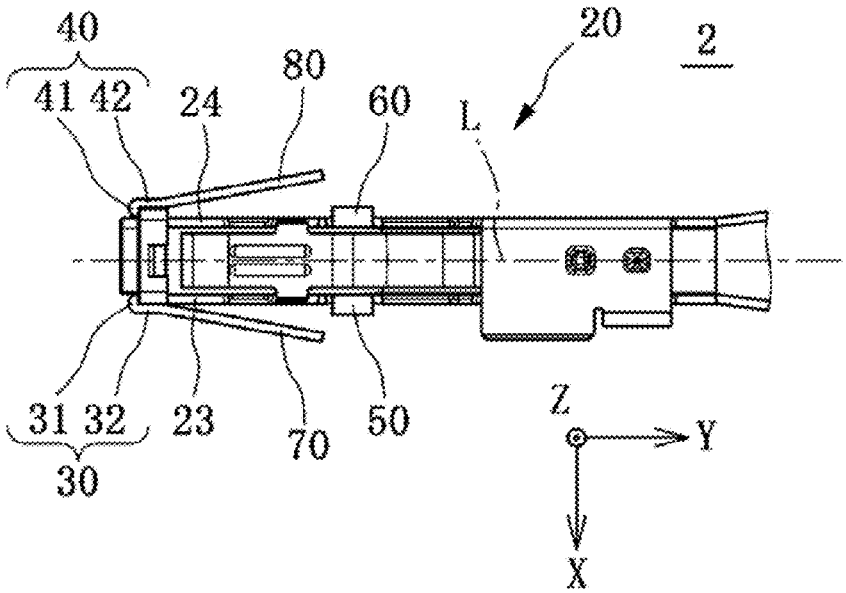
FIG. 10B is a plane view of the connector according to Embodiment 2 of the present disclosure.

A terminal 2 according to Embodiment 2 of the present disclosure comprises, as shown in FIGS. 10A and 10B, a conductive contact plate 10, a conductive body 20, extended parts 30, 40, 50, and 60, lances 70 and 80, and a caulking part (not shown). The terminal 2 according to Embodiment 2 is different from the terminal 1 according to Embodiment 1 in that the folded parts 31 and 41 of the extended parts 30 and 40 are folded in a different shape.

The extended part 30 (the first extended part) is formed at the end on the +X side and on the −Y side of the conductive body 20 (at one end). The extended part 30 has a folded part 31 and an overlapped part 32.

The folded part 31 extends from the leading end (the end on the −Y side) of the side plate 23 and is folded outward from the conductive body 20. In detail, the folded part 31 is folded at an axial line parallel to a direction perpendicular to the Y-axis direction (an axial line parallel to the Z-axis direction).

The overlapped part 32 extends from the leading end of the folded part 31 and overlaps with the side plate 23.

The extended part 40 (the second extended part) is formed at the end on the −X side and on the −Y side of the conductive body 20 (at one end). The extended part 40 has a folded part 41 and an overlapped part 42 like the extended part 30.

The folded part 41 extends from the leading end (the end on the −Y side) of the side plate 24 and is folded outward from the conductive body 20. In detail, the folded part 41 is folded at an axial line parallel to a direction perpendicular to the Y-axis direction (an axial line parallel to the Z-axis direction).

The overlapped part 42 extends from the leading end of the folded part 41 and overlaps with the side plate 24.

The extended part 40 and the extended part 30 are formed at positions symmetric about an axis parallel to the axial direction of the conductive body 20 in a plane view shown in FIG. 10B.

As described above, according to the terminal 2 according to this Embodiment 2, the lances 70 and 80 protrude from the overlapped parts 32 and 42 overlapping with the side plates 23 and 24. Therefore, reduction in the rigidity of the side plates 23 and 24 due to formation of the lances 70 and 80 is suppressed. As a result, the thickness (the measurement in the Z-axis direction) of the terminal 2 can be reduced. Consequently, it is possible to make the terminal 2 small in height while maintaining the strength of the terminal 2. Moreover, the same effect as the terminal 1 according to Embodiment 1 can be obtained.

Embodiment 3

The terminal according to Embodiment 3 of the present disclosure will be described below with reference to FIGS. 11A and 11B. Mainly the difference from Embodiment 2 will be described. It is assumed that the matters other than the described difference are the same as in Embodiment 2. Here, for easier understanding, XYZ coordinates are set up and referred to as necessary.

Figure 11A:
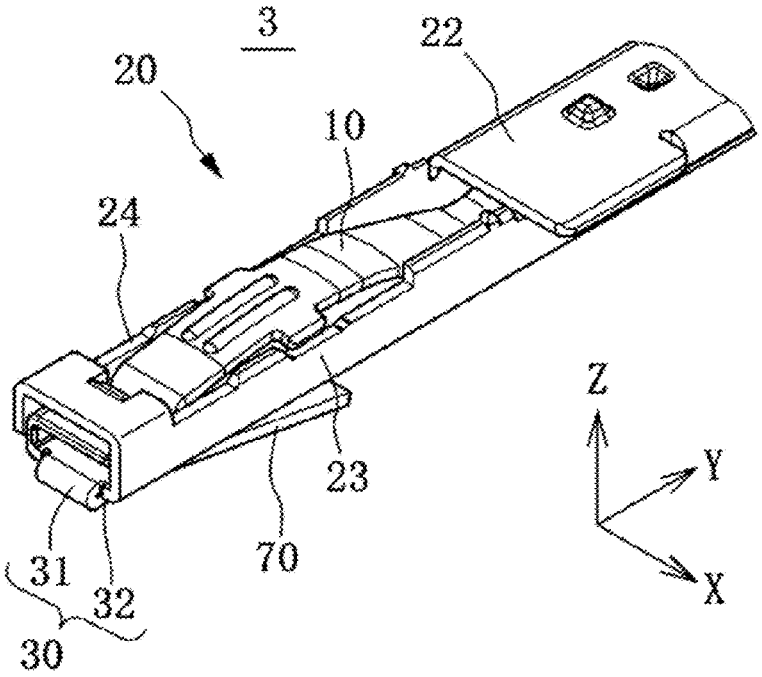
FIG. 11A is a perspective view of the connector according to Embodiment 3 of the present disclosure.
Figure 11B:
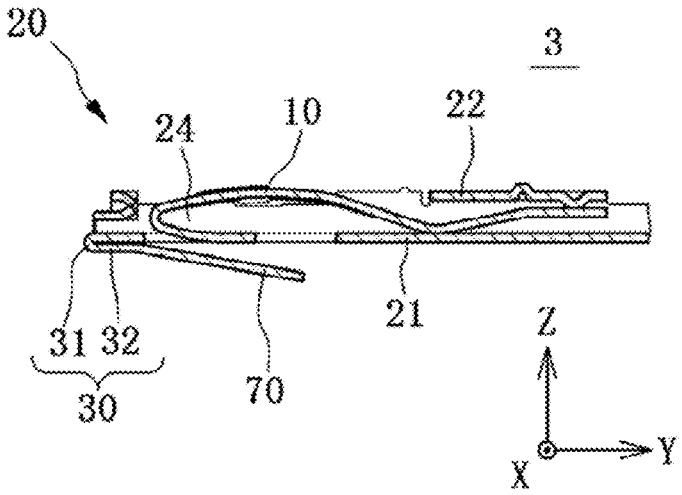
FIG. 11B is a YZ cross-sectional view of the connector according to Embodiment 3 of the present disclosure.

A terminal 3 according to Embodiment 3 of the present disclosure comprises, as shown in FIGS. 11A and 11B, a conductive contact plate 10, a conductive body 20, an extended part 30, a lance 70, and a caulking part (not shown). The terminal 3 according to Embodiment 3 is different from the terminal 2 according to Embodiment 2 in that the folded part 30 formed and the lance formed are different in number.

The extended part 30 (the first extended part) is formed at the end on the −Z side and on the −Y side of the conductive body 20 (at one end). The extended part 30 has a folded part 31 and an overlapped part 32.

The folded part 31 extends from the leading end (the end on the −Y side) of the bottom plate 21 (the first wall) and is folded outward from the conductive body 20. In detail, the folded part 31 is folded at an axial line parallel to a direction perpendicular to the Y-axis direction (an axial line parallel to the X-axis direction).

The overlapped part 32 extends from the leading end of the folded part 31 and overlaps with the bottom plate 21.

The lance 70 (the first lance) is formed to be locked in the lance locking part of the housing so as to retain the terminal 3 in the housing in an unremovable state. The lance 70 is formed to protrude from the overlapped part 32 of the extended part 30. As a result, the lance 70 is formed into the shape of a cantilever beam having the end closer to the overlapped part 32 as a fixed end and the opposite end as a free end. Moreover, the lance 70 has a fold line part in the shape of a fold line formed in parallel to the protruding direction.

The present disclosure is not confined to the above-described embodiments and can be modified in various manners without departing from the gist of the present disclosure.

For example, in this Embodiment 1, the protrusion 23*a* is formed on the side plate 23 but is not formed on the side plate 24. However, this is not restrictive. The protrusion 23*a* may be formed both on the side plate 23 and on the side plate 24.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

What is claimed is:

1. A terminal, comprising:

a conductive contact plate elastic and making contact with a counterpart terminal;

a tube-like conducive body supporting the conductive contact plate and comprising a first wall;

a first extended part comprising a first folded part extending from an end of the first wall and folded outward from the conductive body and a first overlapped part extending from a leading end of the first folded part and overlapping with the first wall, the first extended part being formed at one end of the conductive body;

a first lance in the shape of a cantilever beam protruding from the first overlapped part; and an other-end extended part formed at the other end of the conductive body with the first lance in-between, wherein the other-end extended part comprises an other-end folded part extending from an end of the first wall and folded outward from the conductive body and an other-end overlapped part extending from a leading end of the other-end folded part and overlapping with the first wall.

2. The terminal according to claim 1, wherein:

the conductive body comprises a second wall facing the first wall, and the conductive contact plate is disposed between the first wall and the second wall.

3. The terminal according to claim 2, comprising:

a second extended part comprising a second folded part extending from an end of the second wall and folded outward from the conductive body and a second overlapped part extending from a leading end of the second folded part and overlapping with the second wall; and a second lance in the shape of a cantilever beam protruding from the second overlapped part.

4. The terminal according to claim 1, wherein:

a protrusion protruding from an outer wall surface of the first wall and abutting on the first overlapped part is formed on the conductive body.

5. The terminal according to claim 1, wherein:

the first folded part is folded at an axial line parallel to an axial direction of the conductive body.

6. The terminal according to claim 1, wherein:

the first folded part is folded at an axial line parallel to a direction perpendicular to an axial direction of the conductive body.

7. The terminal according to claim 1, wherein:

the first wall faces the conductive contact plate, and the first folded part is folded at an axial line parallel to a direction perpendicular to an axial direction of the conductive body.

8. The terminal according to claim 1, wherein:

the first lance comprises a fold line part in the shape of a fold line formed in parallel to a protruding direction.

9. A connector according to claim 1, wherein the conductive contact plate includes an elastic arched part and wherein the conductive contact plate is covered by the conductive body and the arched part of the conductive contact plate is exposed from the conductive body.

10. A connector, comprising:

the terminal according to claim 1; and a housing in which an engaging part engaging with the first lance is formed.

* * * * *